United States Patent [19]

Tucker et al.

[11] Patent Number: 4,995,180

[45] Date of Patent: Feb. 26, 1991

[54] GUN LOCK

[76] Inventors: Leslie R. Tucker, New Metford Farm, East Bower; Robin Tucker, Channel View, Over Stowey, both of Nr Bridgewater, Somerset, England

[21] Appl. No.: 523,380

[22] Filed: May 14, 1990

[51] Int. Cl.[5] ..... F41A 17/02

[52] U.S. Cl. ..... 42/70.07; 42/70.110

[58] Field of Search ..... 42/70.07, 70.11

[56] References Cited

U.S. PATENT DOCUMENTS

| | | | |
|---|---|---|---|
| 2,664,658 | 1/1954 | Bjorklund | 42/70.07 |
| 3,392,471 | 7/1968 | Foote . | |
| 4,084,341 | 4/1978 | Cervantes . | |
| 4,509,281 | 4/1985 | Dreiling et al. | 42/70.07 |
| 4,512,099 | 4/1985 | Mathew . | |
| 4,654,992 | 4/1987 | Lavergne . | |
| 4,723,370 | 2/1988 | Sheehan . | |

FOREIGN PATENT DOCUMENTS

| | | |
|---|---|---|
| 1290330 | 9/1972 | United Kingdom . |
| 2044417 | 10/1980 | United Kingdom . |
| 2143623 | 2/1985 | United Kingdom . |

*Primary Examiner*—Charles T. Jordan
*Assistant Examiner*—Richard W. Wendtland
*Attorney, Agent, or Firm*—Larson & Taylor

[57] ABSTRACT

A gun lock has two relatively movable and lockable hooked jaws for restraining movement of components of a gun that must be relatively moved for its operation (e.g. trigger and guard, or grip and stock of a pump action shotgun). The jaws project rearwardly from a body housing a cam rotatable via a key to displace one jaw away from the other.

5 Claims, 1 Drawing Sheet

GUN LOCK

BACKGROUND OF THE INVENTION

The present invention relates to a gun lock, namely to a device which can be engaged with a gun so that the gun is rendered incapable of being fired until the device is disengaged.

At present, there are wall-mounted brackets, racks and the like by means of which a gun such as a rifle or shotgun can be immobilised. But if a gun is released so as to be portable, there is no convenient way of rendering it inoperable by unauthorised persons.

Various gun locks have been proposed. GB No. 2,143,623 and U.S. Pat. No. 4,512,099 disclose devices that are insertable into gun barrels and lockable by radial expansion. These have various disadvantages. For example, they do not prevent the accidental firing of a gun. U.S. Pat. Nos. 3,392,471, 4,084,341 and GB No. 1,290,330 disclose devices having two plates connectable by shanks. In use the plates are located on respective sides of a trigger guard and clamped firmly together by the shank which passes through the guard. Such constructions are not convenient to use, and suit only a limited range of guns. U.S. Pat. Nos. 4,654,992, 4,723,370 and GB No. 2,044,417 disclose locks having pairs of jaws that are relatively movable. Thus U.S. Pat. No. 4,723,370 discloses a device having a ratchet arm that is slidable through a slot in a body when a detent is released with a key. The arm and the body have hook formations pointing away from each other. For use, the arm is slid to bring the hooks close together, and they are inserted into a trigger guard so that one engages the guard and the other engages the trigger. They are then manually urged as far apart as possible, and locked by removal of the key. This operation is rather tricky. The fact that both body and arm have to be insertable between a trigger and a guard imposes severe manufacturing constraints. A particular device is likely to fit only a limited range of guns.

SUMMARY OF THE INVENTION

The present invention provides a lock for a gun comprising:

a body having a rear face;

first and second elongate jaw means mounted to said body and extending rearwardly of said rear face, said first and second jaw means having oppositely directed hook formations;

pivot means pivotally mounting said first jaw means to said body so that it is pivotable towards and away from said second jaw means;

cam means displaceably mounted to said body adjacent said first jaw means, said cam means having a cam surface and said first jaw means having follower means for cooperating with said cam surface, said cam surface being shaped so that displacement of the cam means in one sense urges said first jaw means to pivot away from said second jaw means; and security actuator means for actuating displacement of said cam means.

Thus the lock can be used to hold components apart, particularly relatively movable portions of a gun, e.g. a trigger and a trigger guard, or the finger grip portion of the action of a pump action shotgun and a fixed part of the stock. Of course, such a lock can also be used for other purposes.

The cam means may be rotary. The security actuation means may be operable by insertion and rotation of a key, or by rotating combination tumblers.

A key lock may comprise a member rotatable by means of a key, said cam means being rotatable by engagement with said member. Preferably this engagement is via a lost motion coupling. Thus a key may be insertable and removable only in a specific orientation, and a key that has been inserted and turned to rotate the cam to a desired extent can be returned to that orientation for removal without displacing the cam.

In another aspect, the invention provides, in combination, a gun and a said lock.

DESCRIPTION OF THE PREFERRED EMBODIMENT

Figures 1, 2, 3:
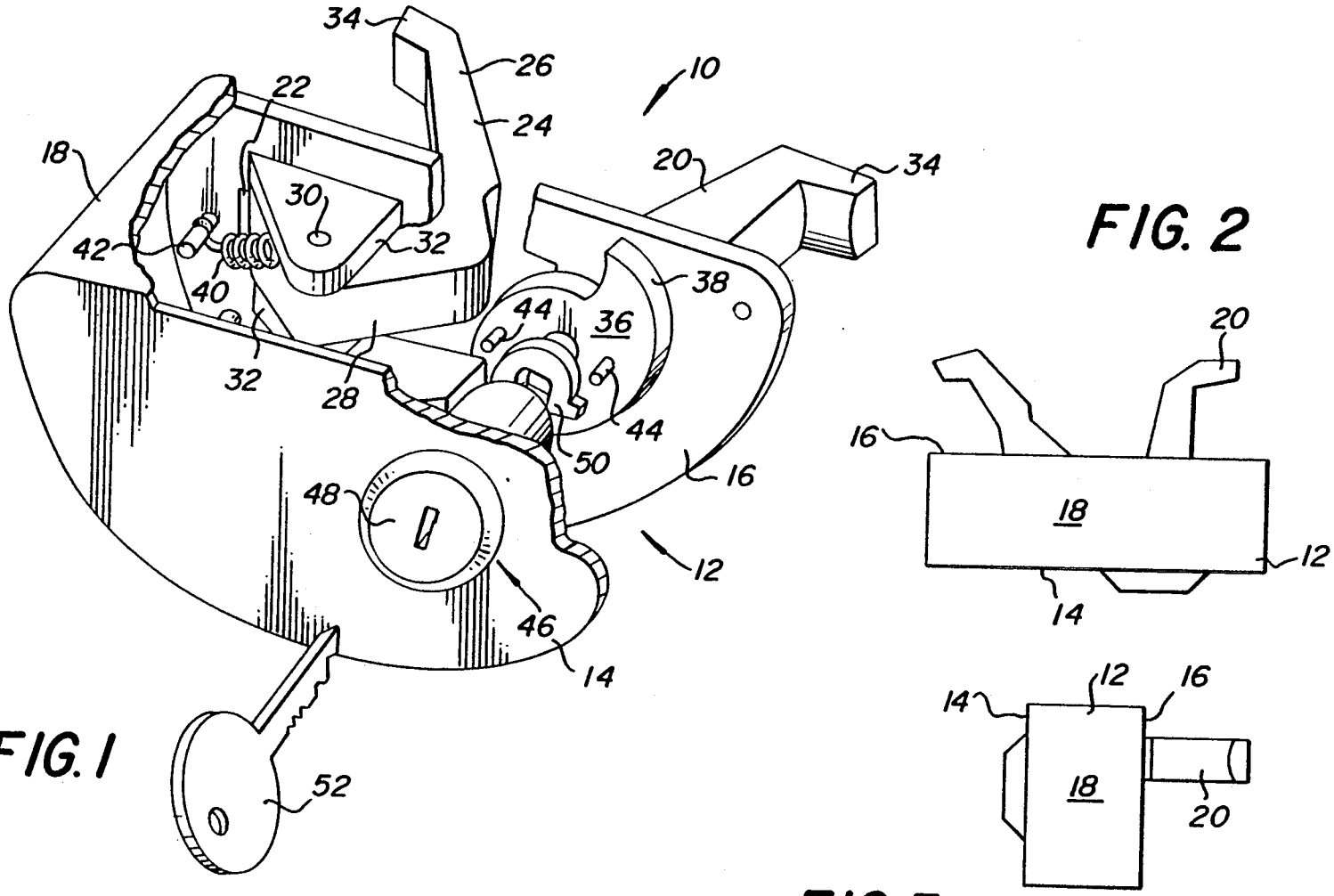
FIG. 1 is a perspective view of a gun lock embodying the invention, partly cut away.
FIG. 2 is a plan view.
FIG. 3 is a side elevation.

The illustrated lock 10 has a body providing a hollow casing 12 having approximately D-shaped front and rear flat walls 14,16 and a peripheral wall 18. A fixed jaw 20 projects from the rear wall 16, adjacent a slot 22 through which a movable jaw 24 projects. The movable jaw 24 comprises a projecting arm portion 26, and a lever portion 28 which extends at an angle to the projecting portion within the casing 12. The lever portion 28 is generally triangular in shape, one vertex being fast with the projecting portion 26, and one vertex being pivotally mounted (30) to brackets 32 that project inwardly from the rear wall 16. The slot 22 allows the movable jaw 24 to pivot, so that the projecting portion 26 is movable towards and away from the fixed jaw 20. Both have, at their outer ends, oppositely directed hook portions 34.

A cam 36 with a spiral cam surface 38 is rotatably mounted on the inner face of the rear wall 16 so that its cam surface 38 confronts the movable jaw 24, adjacent the vertex 29 of the lever portion which is fast with the projecting portion. The movable jaw 24 is urged against the cam surface 38 by means of a spring 40 extending between the lever portion 28 and a peg 42 projecting from the rear wall 16. Rotation of the cam 36 causes displacement of the movable jaw 24 away from the fixed jaw 20. The cam 36 bears a pair of inwardly projecting pins 44, diametrically opposite one another.

A lock assembly 46 is mounted to the front wall 14. It includes a key plate 48 fast with the front wall, and a rear actuating member 50 which is rotatable by means of a key 52 when this is inserted into the lock and turned. The actuating member 50 is coaxial with the cam 36. It has a radial projection 52 for abutting the pins 44 of the cam. The arrangement of the projection 52 and the pins 44 constitutes a lost motion coupling. Thus when the key 52 is inserted in the lock and turned, the cam 36 is not moved until the actuating member 50 has moved so that its projection 52 engages a pin 44. Thereafter, continued rotation of the member 50 rotates the cam. If it is being rotated clockwise (as viewed in FIG. 1), then the movable jaw 24 is moved progressively away from the fixed jaw 20. At any time the rotation can be stopped. The key can be turned back to the vertical position without moving the cam, and the key can then be withdrawn.

For use, the movable jaw 26 will initially be close to the fixed jaw 20. The jaws are then engaged with members that are to be held relatively immobile, e.g. between a trigger and a trigger guard. The key is then inserted and turned to move the movable jaw 26 until the engagement with the trigger and guard is such that it can be moved no farther. The key is then turned back to the vertical position and removed.

The body of the lock 10 can be formed of metal. For the jaws, a preferred material is hardened nitrile rubber. This is very tough. Its non-slip surface facilitates engagement. If someone endeavours to smash off the lock using a hammer, it is far more likely that the trigger of the gun will be broken than that the lock will break.

While the invention has been described above with reference to the preferred embodiment, it will be understood by those skilled in the art that various changes and modifications can be made without departing from the spirit and scope of the invention; and it is intended to cover all such changes and modifications by the appended claims.

We claim:

1. A lock for a gun comprising:

a body having a rear face;

first and second elongate jaw means mounted to said body and extending rearwardly of said rear face, said first and second jaw means having oppositely directed hook formations;

pivot means pivotally mounting said first jaw means to said body so that it is pivotable towards and away from said second jaw means;

cam means displaceably mounted to said body adjacent said first jaw means, said cam means having a cam surface and said first jaw means having follower means for cooperating with said cam surface, said cam surface being shaped so that displacement of the cam means in one sense urges said first jaw means to pivot away from said second jaw means; and security actuator means for actuating displacement of said cam means.

2. A lock for a gun according to claim 1 wherein said cam is rotatably mounted and said cam surface is spiral in form.

3. A lock for a gun according to claim 2 wherein said security actuation means are key operable means adapted to accept a key only in a predetermined orientation, and comprise an element which is rotatable by means of a key and is coupled to said cam means via a lost motion coupling such that after rotation of said key, element and cam to effect pivoting of said first jaw means away from said second jaw means to a desired extent, said key is rotatable back to the predetermined orientation in which it is removable with conomitant rotation of said element while the cam remains in its rotated configuration.

4. A lock according to claim 1 further including spring means coupled to said first jaw means to urge it resiliently towards said second jaw means.

5. A lock for a gun according to claim 1 wherein said first and second jaw means each comprise hardened nitrile rubber.

* * * * *